US005937836A

United States Patent [19]

Yonezawa et al.

[11] Patent Number: 5,937,836

[45] Date of Patent: Aug. 17, 1999

[54] LUBRICATING AND BREATHER SYSTEM IN ENGINE

[75] Inventors: Makoto Yonezawa; Hiroaki Kojima; Yasutake Ryu; Toru Taniguchi, all of Wako, Japan

[73] Assignee: Honda Giken Kogyo kabushiki Kaisha, Tokyo, Japan

[21] Appl. No.: 08/957,318

[22] Filed: Nov. 6, 1997

[30] Foreign Application Priority Data

Nov. 11, 1996 [JP] Japan ..... 8-298741

[51] Int. Cl.[6] ..... F01M 3/00

[52] U.S. Cl. ..... 123/572

[58] Field of Search ..... 123/572, 573, 123/574

[56] References Cited

U.S. PATENT DOCUMENTS

| | | | |
|---|---|---|---|
| 4,470,389 | 9/1984 | Mitadera et al. . | |
| 4,881,510 | 11/1989 | Etoh et al. | 123/572 |
| 5,261,380 | 11/1993 | Romano | 123/573 |
| 5,447,127 | 9/1995 | Lück et al. . | |
| 5,474,035 | 12/1995 | Ming et al. . | |
| 5,690,084 | 11/1997 | Gunji et al. | 123/573 |
| 5,706,769 | 1/1998 | Shimizu | 123/572 |
| 5,794,602 | 8/1998 | Kimura | 123/572 |

FOREIGN PATENT DOCUMENTS

| | | |
|---|---|---|
| 0 294 786 A2 | 12/1988 | European Pat. Off. . |
| 0 407 696 A1 | 1/1991 | European Pat. Off. . |

*Primary Examiner*—Marguerite McMahon
*Attorney, Agent, or Firm*—Nikaido, Marmelstein, Murray & Oram LLP

[57] ABSTRACT

A lubricating and breather system is provided for use with a crankcase and a cylinder block in both a horizontal-type engine and a vertical-type engine, in which the discharge of a blow-by gas and the circulation of oil separated from the blow-by gas into the crankcase can be reliably performed. When the engine is of a vertical-type, it includes a crankcase which is disposed so that a second bearing boss is located above a first bearing boss. The second bearing boss is provided with an annular chamber into which splashed oil produced in the crankcase is passed. A breather chamber is provided in a cylinder block to communicate with the annular chamber, and includes a first return bore provided in a portion thereof which is a lowermost portion when in the horizontal-type engine, and a second return bore in a portion thereof which is a lowermost portion when in the vertical-type engine.

2 Claims, 10 Drawing Sheets

LUBRICATING AND BREATHER SYSTEM IN ENGINE

BACKGROUND OF THE INVENTION

1. Field of the Invention

The present invention relates to a lubricating and breather system for use in a horizontal-type engine or a vertical-type engine including a crankcase and a cylinder block.

2. Description of the Prior Art

Prior art type engines include a horizontal-type in which a crankshaft is disposed horizontally, and a vertical-type in which a crankshaft is disposed vertically. In the conventional engines, the crankcase and the cylinder block are different for each of the types, because of different conditions of the arrangement of a discharge passage for a blow-by gas produced in the crankcase and a return passage for oil separated from the blow-by gas and returned to the crankcase.

The different construction of the crankcase and the cylinder block in each of the types is inconvenient for providing a mass-produced engine, resulting in higher cost.

SUMMARY OF THE INVENTION

The present invention has been accomplished with such circumstance in view, and it is an object of the present invention to provide a lubricating and breather system in an engine, wherein even if the crankcase and the cylinder block are of the horizontal or vertical-types, the discharge of the blow-by gas and the circulation of the oil separated from the blow-by gas, to the crankcase can be reliably performed.

To achieve the above object, according to a first aspect and feature of the present invention, there is provided a lubricating and breather system in an engine which includes a crankcase and a cylinder block, which is commonly applied to a horizontal-type engine and a vertical-type engine. The crankcase is formed with first and second bearing bosses supporting first and second journal portions of a crankshaft, the first and second bearing bosses being disposed so that the second bearing boss lies above the first bearing boss when the engine is of the vertical-type. The lubricating and breather system comprises an annular chamber which is provided in the second bearing boss and into which splashed oil produced in the crankcase is passed in both the horizontal and vertical engine types; a breather chamber which is provided in one side of the cylinder block, communicates with the annular chamber to separate a gas and a liquid, the breather chamber having a first return bore provided in a portion thereof which is a lowermost portion when in the horizontal-type engine to communicate with the inside of the crankcase, and a second return bore provided in a portion thereof which is a lowermost portion when in the vertical-type engine, to communicate with the inside of the crankcase; and a breather tube connected to an intake system of the engine and also connected to a portion of the breather chamber which is located above the first return bore when in the horizontal-type engine and above the second return bore when in the vertical-type engine.

Thus, while the crankcase and the cylinder block can be commonly used in each of the types of engines, the second journal portion of the crankshaft in each of the types can always be reliably lubricated by splashed oil. The blow-by gas from which oil has been separated in the breather chamber, can be discharged into the intake system through the same breather tube. Further, the oil separated from the blow-by gas can be circulated into the crankcase through the first return bore when in the horizontal-type engine and through the second return bore when in the vertical-type engine.

According to a second aspect and feature of the present invention, in addition to the first feature, a cone-shaped oil reservoir extending down toward the second journal portion, is defined in the end face of the second bearing boss which faces the annular chamber. Thus, when in a vertical-type engine, the splashed oil entering the annular chamber can be accumulated in the oil reservoir to effectively lubricate the second journal portion located above the first journal portion.

DETAILED DESCRIPTION OF THE PREFERRED EMBODIMENT

The mode for carrying out the present invention will now be described by way of an embodiment shown in the accompanying drawings.

First, the present invention will be described as being applied to a horizontal-type engine with reference to FIGS. 1 to 7.

Figure 1:
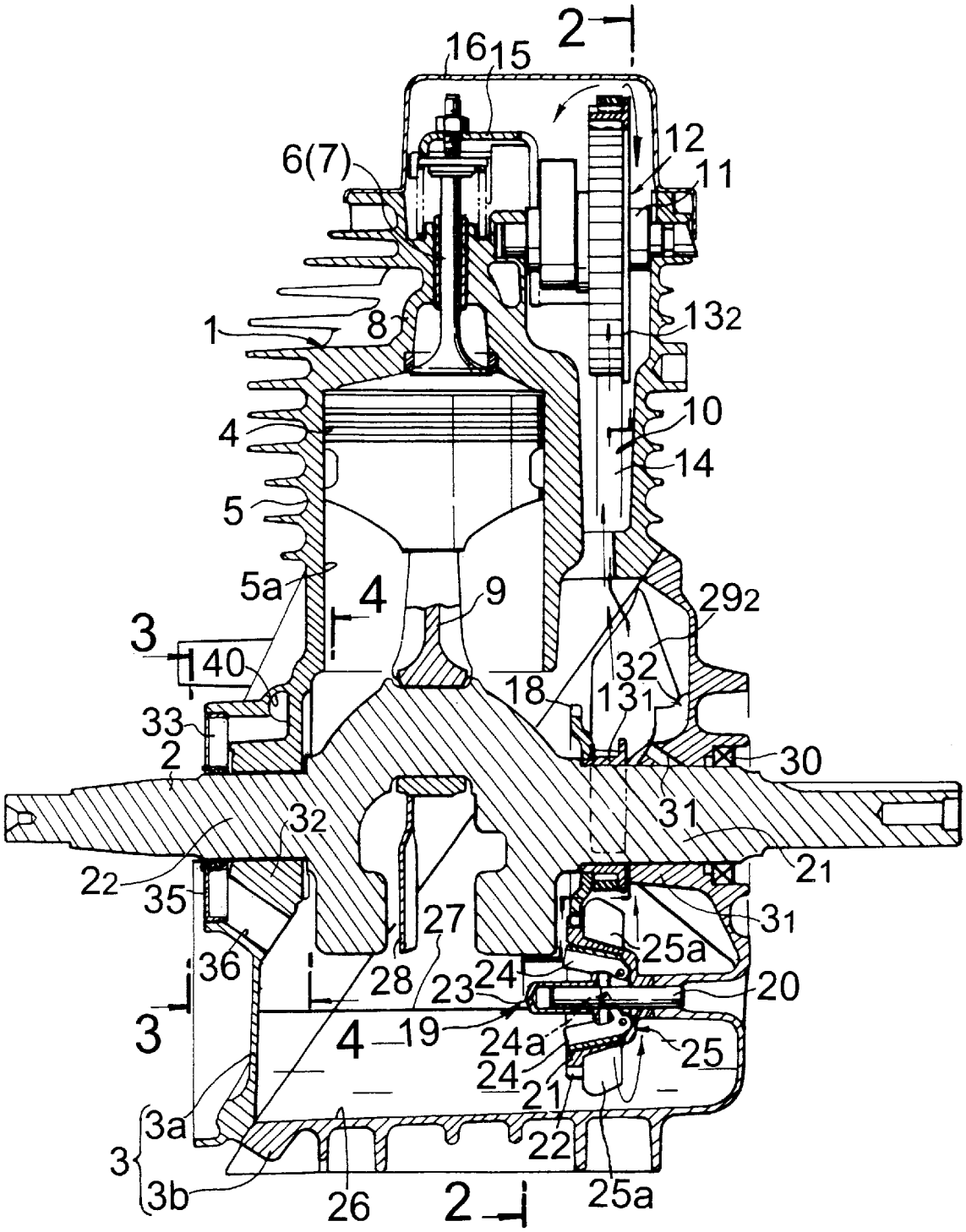
FIG. 1 is a vertical sectional side view of an embodiment of the present invention applied to a horizontal-type engine.
Figure 2:
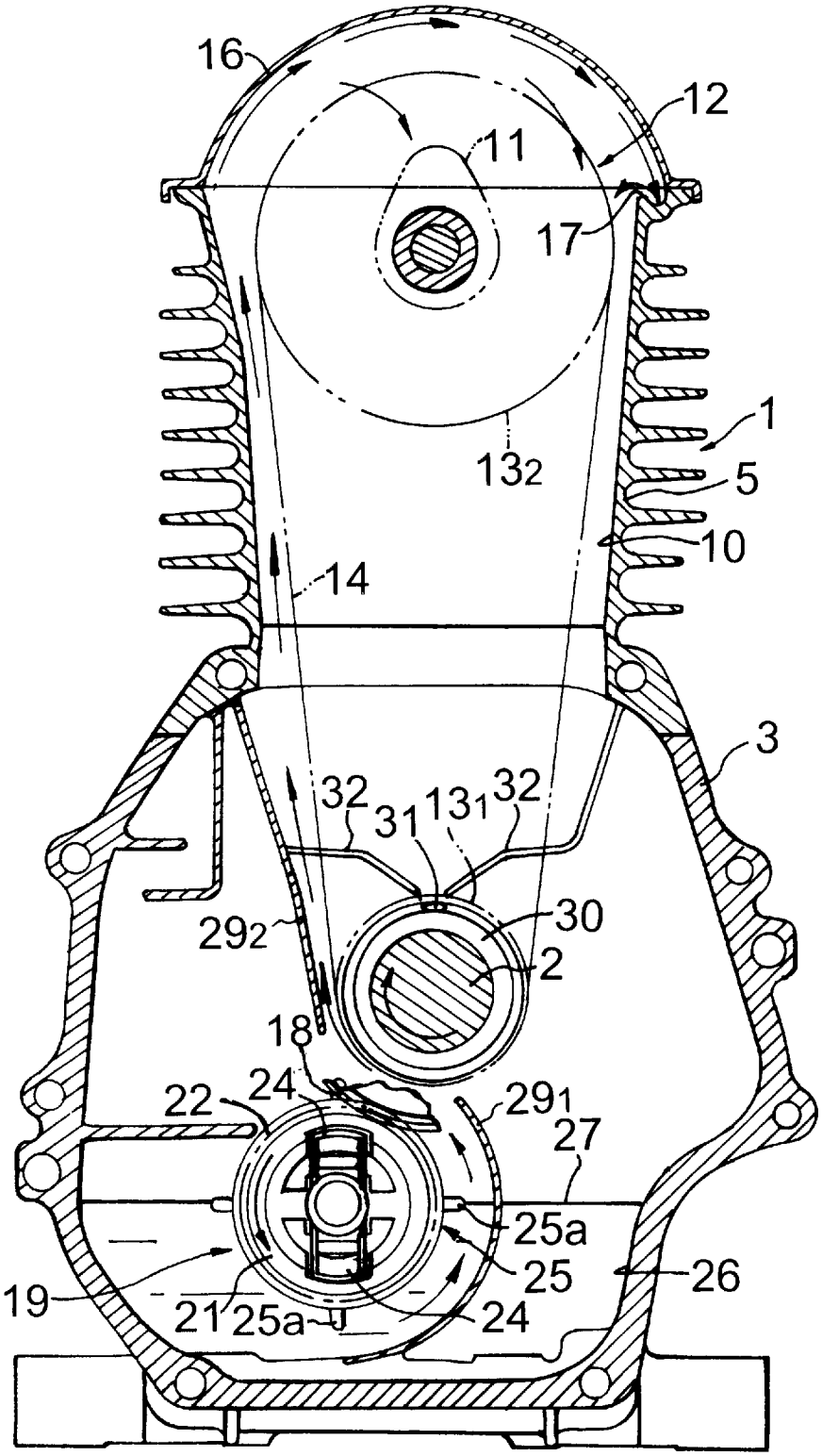
FIG. 2 is a vertical sectional view taken along a line 2—2 in FIG. 1.

Referring to FIGS. 1 and 2, an engine body 1 is comprised of a crankcase 3 which supports a crankshaft 2 disposed horizontally. A cylinder block 5 has a cylinder bore 5*a* in which a piston 4 slides, and a cylinder head 8 in which intake and exhaust valves 6 and 7 are supported. The crankshaft 2 and the piston 4 are interconnected by a connecting rod 9. The crankcase 3 is divided into an upper case half 3*a* and a lower case half 3*b* along a diagonal line on the case 3, which obliquely intersects an axis of the crankshaft 2. The upper case half 3*a* , the cylinder block 5 and the cylinder head 8 are integrally formed. In this way, the engine body 1 is formed of two parts and moreover, is applicable to a vertical-type engine. The upper and lower case halves 3*a* and 3*b* are separatably coupled to each other by a bolt or bolts.

A flat valve-operating transmitting chamber 10 is defined in one side of the cylinder block 5 adjacent the cylinder bore 5*a* , and a timing transmitting device 12 is disposed in the chamber 10, and interconnects the crankshaft 2 and a valve-operating cam shaft 11 supported on the cylinder head 8. The timing transmitting device 12 is comprised of a toothed driving pulley $\mathbf{13}_1$ secured to the crankshaft 2, a toothed driven pulley $\mathbf{13}_2$ secured to the valve-operating cam shaft 11, and a toothed belt 14 reeved around both the pulleys $\mathbf{13}_1$ and $\mathbf{13}_2$, so that the rotation of the crankshaft 2 is reduced to one half and transmitted to the valve-operating cam shaft 11. The valve-operating cam shaft 11 is adapted to open and close the intake and exhaust valves 6 and 7 through a rocker arm 15 by the rotation thereof. Upper portions of the timing transmitting device 12 and the rocker arm 15 are covered by a head cover 16 coupled to an upper surface of the cylinder head 8 by bolts. In this case, an upward directed step 17 is formed between the cylinder head 8 and the head cover 16 to face a downward traveling portion of the belt 14, and has a recess.

A governor driving gear 18 is secured to the crankshaft 2 adjacent the driving pulley $\mathbf{13}_1$, and a speed-adjusting centrifugal governor 19 driven by the governor driving gear 18, is disposed below the crankshaft 2. The centrifugal governor 19 includes a rotary table 21 supported on a support shaft 20 which is fixedly mounted on a sidewall of the crankcase 3 and extending parallel to the crankshaft 2. A driven gear 22 is formed around an outer periphery of the rotary table 21 and is meshed with the driving gear 18. The centrifugal governor 19 is formed by the rotary table 21, a tubular slider 23 slidably supported on the support shaft 20, and a plurality of swinging pendulum-type centrifugal weights 24 which are swingably supported on the rotary table 21 to sandwich the slider 23. Each of the centrifugal weights 24 includes an operating arm 24*a* which allows the slider 23 to slide in one direction, when the weight 24 is swung radially outwards by centrifugal force. When the slider 23 slides in the one direction, a throttle valve in the intake system is operated to a closed position through a link mechanism (not shown) and the number of revolutions of the engine is controlled to a preset value, in a conventional manner.

The rotary table 21 has a plurality of vanes 25*a* projectingly formed on an outer peripheral surface thereof to form an impeller 25.

A lower portion of the inside of the crankcase 3 is formed into an oil reservoir chamber 26, and the amount of lubricating oil 27 stored in the chamber 26 is set so that the lower half of the impeller 25 is immersed in the oil below an oil level, and so that the crankshaft 2 and the driving pulley 13, are above the oil level and do not contact the oil. Thus, it is possible to produce the required amount of oil splashed by the impeller 25, while avoiding a power loss due to the agitation of the lubricating oil by the crankshaft 2 and timing transmitting device 12.

An oil dipper 28 for splashing the lubricating oil 27 due to its motion, is formed at the larger-diameter end of the connecting rod 9.

Integrally formed on an inner wall of the crankcase 3, e.g., on an inner wall of the lower case half 3*b* in the illustrated embodiment, are a first arcuate guide wall $\mathbf{29}_1$ which covers an upward rotating path of the vanes 25*a* of the impeller 25, and a second guide wall $\mathbf{29}_2$ which covers a rising path of the belt 14 from the driving pulley $\mathbf{13}_1$ to the chamber 10.

In the crankshaft 2, a journal portion $\mathbf{2}_1$ on the side of the timing transmitting device 12 is called a first journal portion, and a journal portion $\mathbf{2}_2$ on the opposite side is called a second journal portion. In the crankcase 3, bearing bosses $\mathbf{3}_1$ and $\mathbf{3}_2$ carrying the first and second journal portions $\mathbf{2}_1$ and $\mathbf{2}_2$ are called first and second bearing bosses, respectively. When the engine body 1 is applied to a vertical engine, it is disposed so that the second bearing boss $\mathbf{3}_2$ lies above the first bearing boss $\mathbf{3}_1$ (see FIG. 8).

An oil bore 31 is provided in an upper wall of the first bearing boss $\mathbf{3}_1$ to reach an inner surface of the first bearing boss $\mathbf{3}_1$, and a pair of oil collecting walls 32 is integrally formed on an inner wall of the crankcase 3 on opposite sides of the oil bore 31 to extend upwards in a V-shape from the first bearing boss $\mathbf{3}_1$. An oil seal 30 is mounted at an outer end of the first bearing boss $\mathbf{3}_1$ to come into close contact with an outer periphery of the first journal portion $\mathbf{2}_1$.

Figure 3:
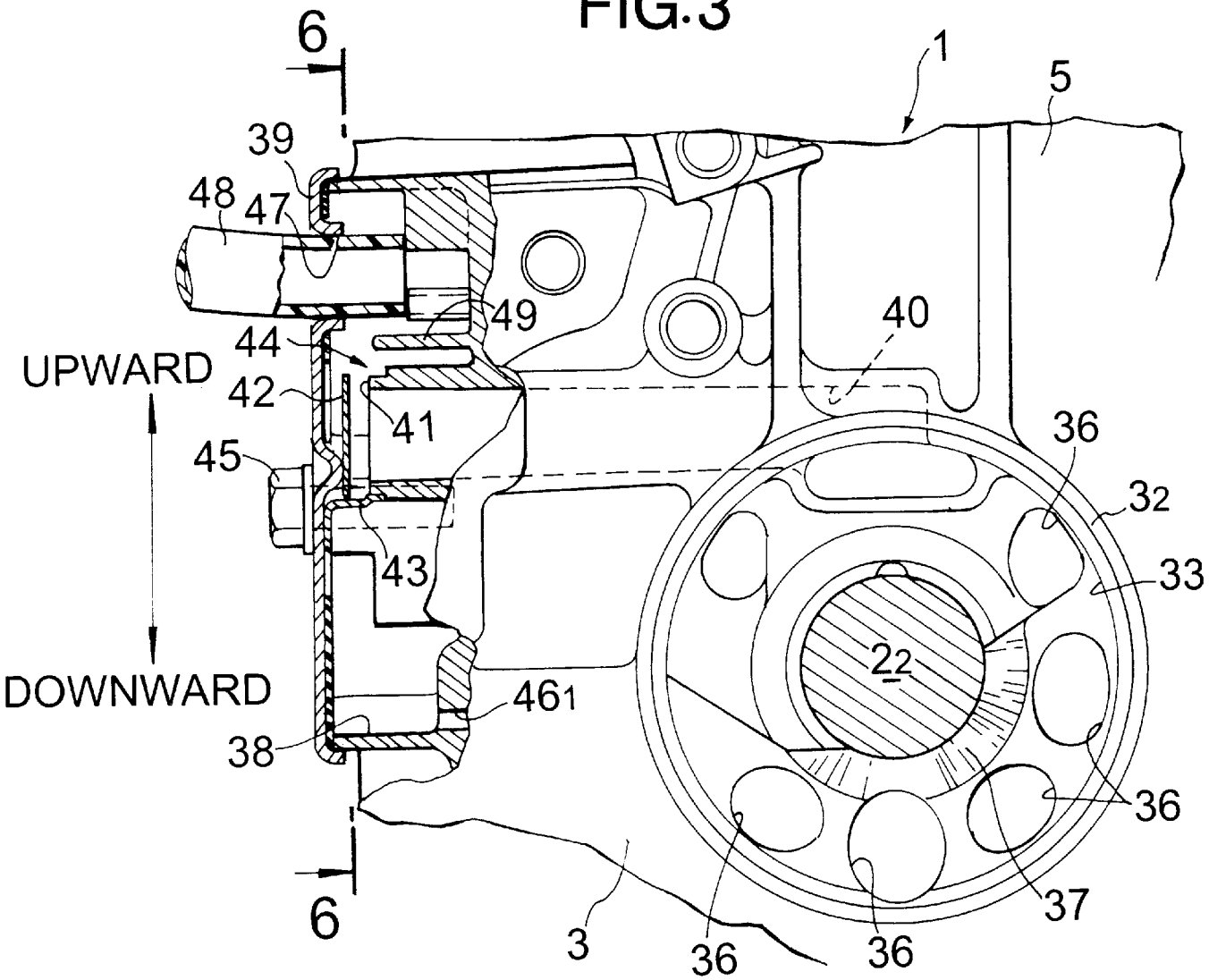
FIG. 3 is a view taken in a direction of an arrow 3—3 in FIG. 1 with the cap for the annular chamber being removed.
Figure 4:
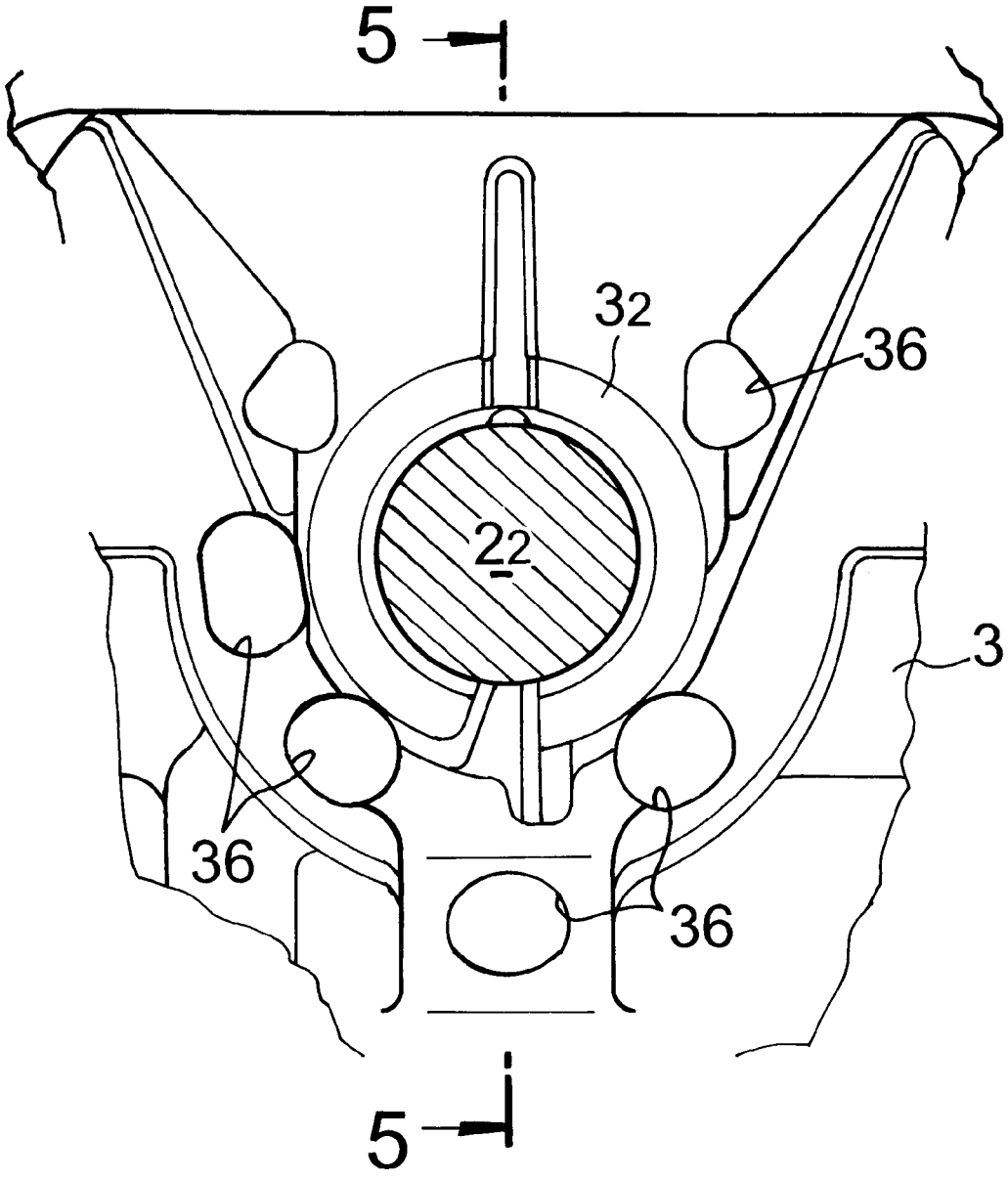
FIG. 4 is a sectional view taken along a line 4—4 in FIG. 1.
Figure 5:
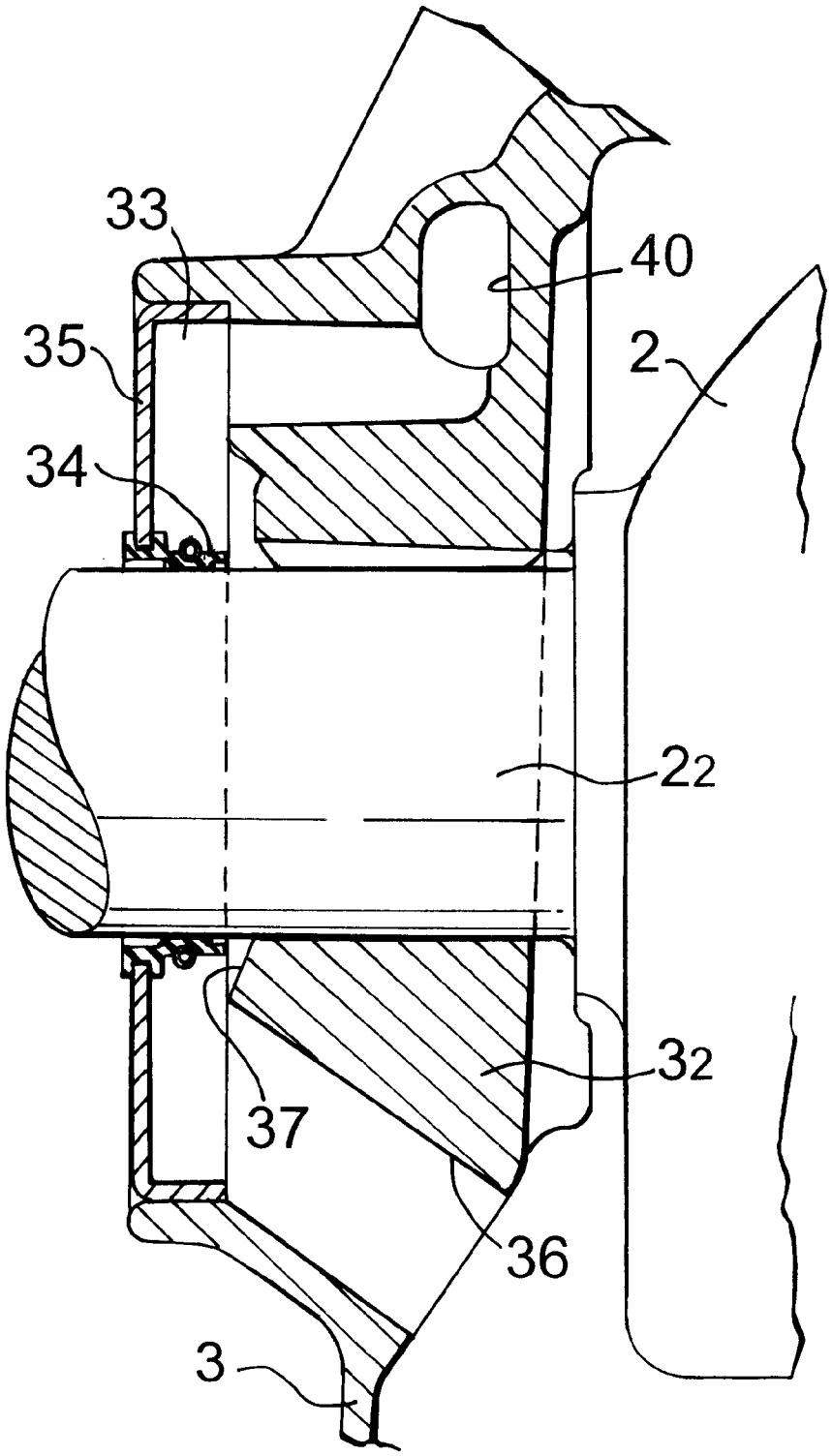
FIG. 5 is a sectional view taken along a line 5—5 in FIG. 4.

In FIGS. 3 to 5, a circular recess 33 is defined in an outer end face of the second bearing boss $\mathbf{3}_2$ of the crankcase 3 and is formed as an annular chamber by closing it with a cap 35 having an oil seal 34 in close contact with an outer peripheral surface of the crankshaft 2. A plurality of through-holes 36, which permit the annular chamber 33 to communicate with the inside of the crankcase 3, is provided in the second bearing boss $\mathbf{3}_2$ to surround the crankshaft 2. A cone-shaped oil reservoir 37 is partially or entirely defined in the end face of the second bearing boss $\mathbf{3}_2$ which faces the annular chamber 33.

Figure 6:
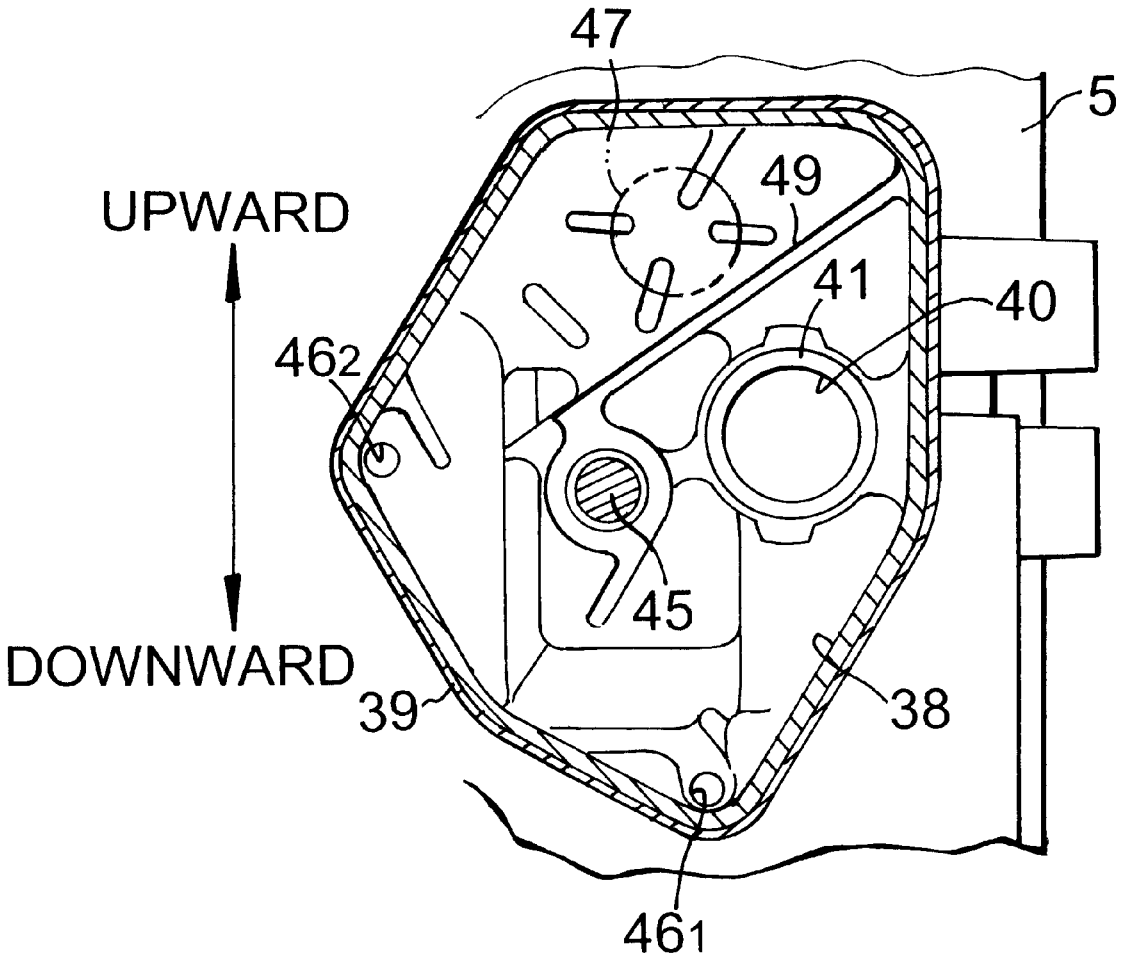
FIG. 6 is a sectional view taken along a line 6—6 in FIG. 3.
Figure 7:
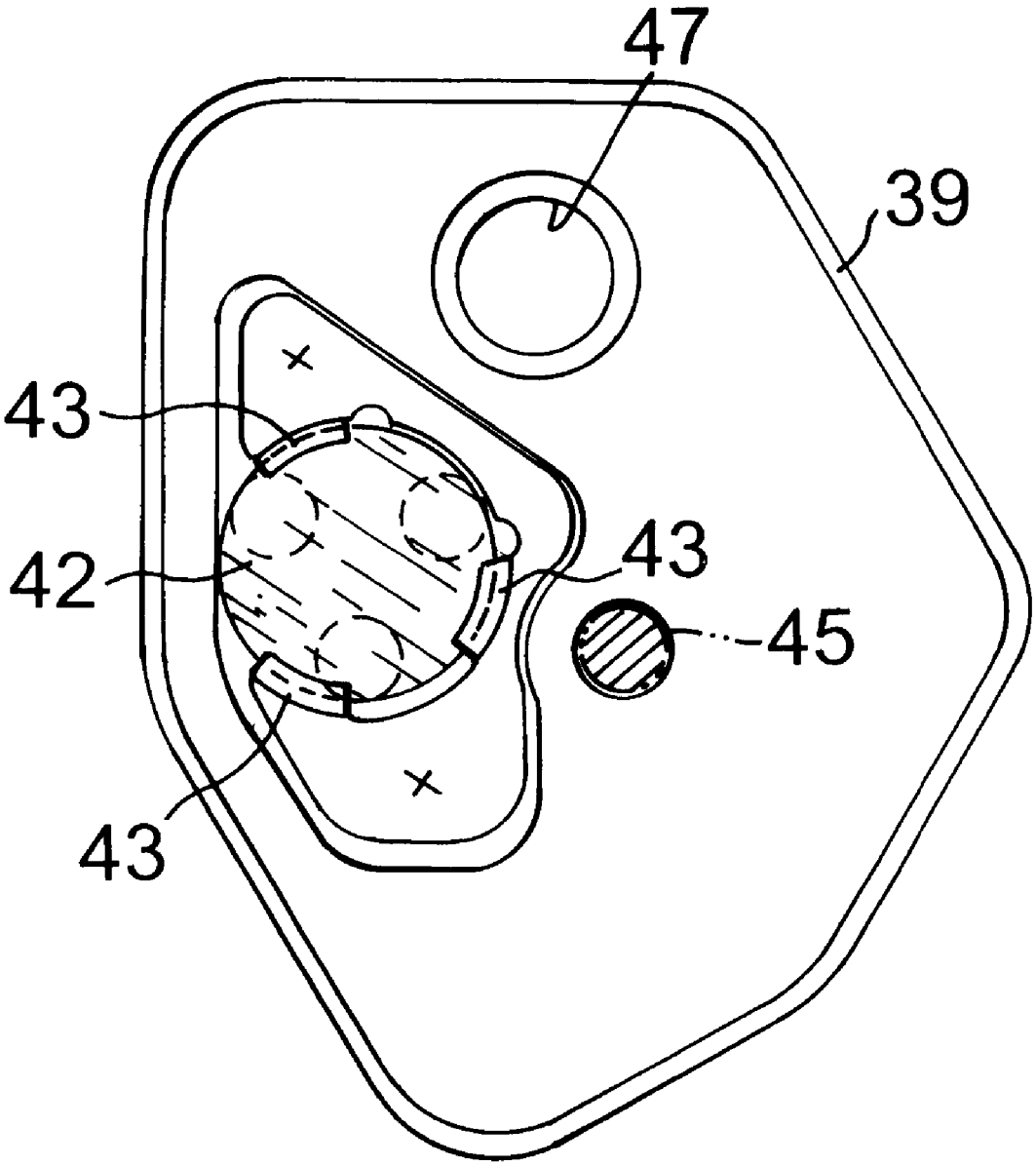
FIG. 7 is an inner side view of a lid for a breather chamber.

A polygonal recess 38 is defined in one side of the cylinder block 5 and is formed as a breather chamber by closing its opened surface with lid 39. A breather passage 40 extends from the cylinder block 5 to the crankcase 3, and permits the breather chamber 38 to communicate with the annular chamber 33. As shown in FIGS. 3, 6 and 7, the end face of an opening of the breather passage 40 into the breather chamber 38 is formed on valve seat 41, and a plurality of support pieces 43 are welded to the lid 39 for supporting the valve plate 42 opposed to the valve seat 41 for opening and closing movements. The valve seat 41 and the valve plate 42 form a check valve 44 which is adapted to be opened upon increasing of the pressure in the crankcase 3 and to be closed upon decreasing of the pressure in the crankcase 3. The lid 39 is secured to the cylinder block 5 by a bolt 45.

In the breather chamber 38, a first return bore $\mathbf{46}_1$ is provided at a portion which is a lowermost portion when the engine body 1 is a horizontal-type engine, and a second return bore $\mathbf{46}_2$ is provided at a portion (see FIG. 6) which is a lowermost portion when the engine body 1 is a vertical-type engine. Both of the return bores $\mathbf{46}_1$ and $\mathbf{46}_2$ lead to the inside of the crankcase 3. Moreover, each of the return bores $\mathbf{46}_1$ and $\mathbf{46}_2$ has a diameter far smaller than that of the breather passage 40 to inhibit as much as possible, the flowing-through of the blow-by gas.

A connecting bore 47 is provided in the lid 39 and opens into the breather chamber 38. A breather tube 48 connected to an air cleaner (not shown) in the intake system of the engine is connected to the connecting bore 47. The connecting bore 47 is located above the first return bore $\mathbf{46}_1$, when the engine body 1 is applied to a horizontal-type engine, and at a location above the second return bore $\mathbf{46}_2$, when the engine body 1 is applied to a vertical-type engine.

In the breather chamber 38, a partition wall 49 is integrally formed on the sidewall of the cylinder block 5 to separate the valve seat 41 and the connecting bore 47 from each other.

The operation of this embodiment will be described below.

During operation of the engine, the timing transmitting device 12 and the centrifugal governor 19 are simultaneously driven by the crankshaft 2. When the centrifugal governor 19 is driven, the rotary table 21, i.e., the impeller 25 allows the lubricating oil 27 in the oil reservoir chamber 26 to splash upwards, while agitating the lubricating oil 27. The splashed oil is first guided to the first guide wall $29_1$ and directed to the driving pulley $13_1$ of the timing transmitting device 12 and the second guide wall $29_2$, and then guided to the valve-operating transmitting chamber 10 by the second guide wall $29_2$, whereby the timing transmitting device 12 can be effectively lubricated. The oil which has lubricated the timing transmitting device 12 splashes from the device 12 to lubricate valve-operating mechanism elements such as the valve-operating cam shaft 11, the rocker arm 15 and the like. Particularly, the oil splashed from driven pulley $13_2$ of the timing transmitting device 12 strikes the upward-turned step 17 between the cylinder head 8 and the head cover 16 to splash around again, whereby the valve-operating mechanism elements can be well lubricated. The oil after lubricating the above elements, flows down the inner wall of the chamber 10. A portion of the oil is introduced into the oil bore 31 in the bearing boss $3_1$ by the oil collecting wall 32 and flows to lubricate the first journal portion $2_1$ of the crankshaft 2. The remainder of the oil is returned to the oil reservoir chamber 26.

The lubricating oil 27 in the oil reservoir chamber 26 is agitated for splashing by the oil dipper 28 which is repeatedly moved up and down and swung along with the connecting rod 9. The splashed oil is passed through the through-bore 36 in the second bearing boss $3_2$ into the annular chamber 33 to lubricate the second journal portion $2_2$ of the crankshaft 2, in addition to the lubrication of the crankshaft 2, the connecting rod 9, the piston 4 and the like.

The pressure in the crankcase 3 is repeatedly increased and decreased with the lifting and lowering movements of the piston 4. When the pressure in the crankcase 3 is increased, the check valve 44 is opened, so that the pressure is transferred along with the blow-by gas via the annular chamber 33 and the breather passage 40 into the breather chamber 38, where the oil contained in the blow-by gas is separated by the partition wall 49. The blow-by gas is guided to the air cleaner (not shown) by the breather tube 48 and discharged, and the separated oil is returned into the crankcase 3 through the first return bore $46_1$ located at the lowermost portion of the breather chamber 38 (see FIG. 6). When the pressure in the crankcase 3 is decreased, the check valve 44 is closed, whereby the back flow of the blow-by gas can be prevented.

Figure 8:
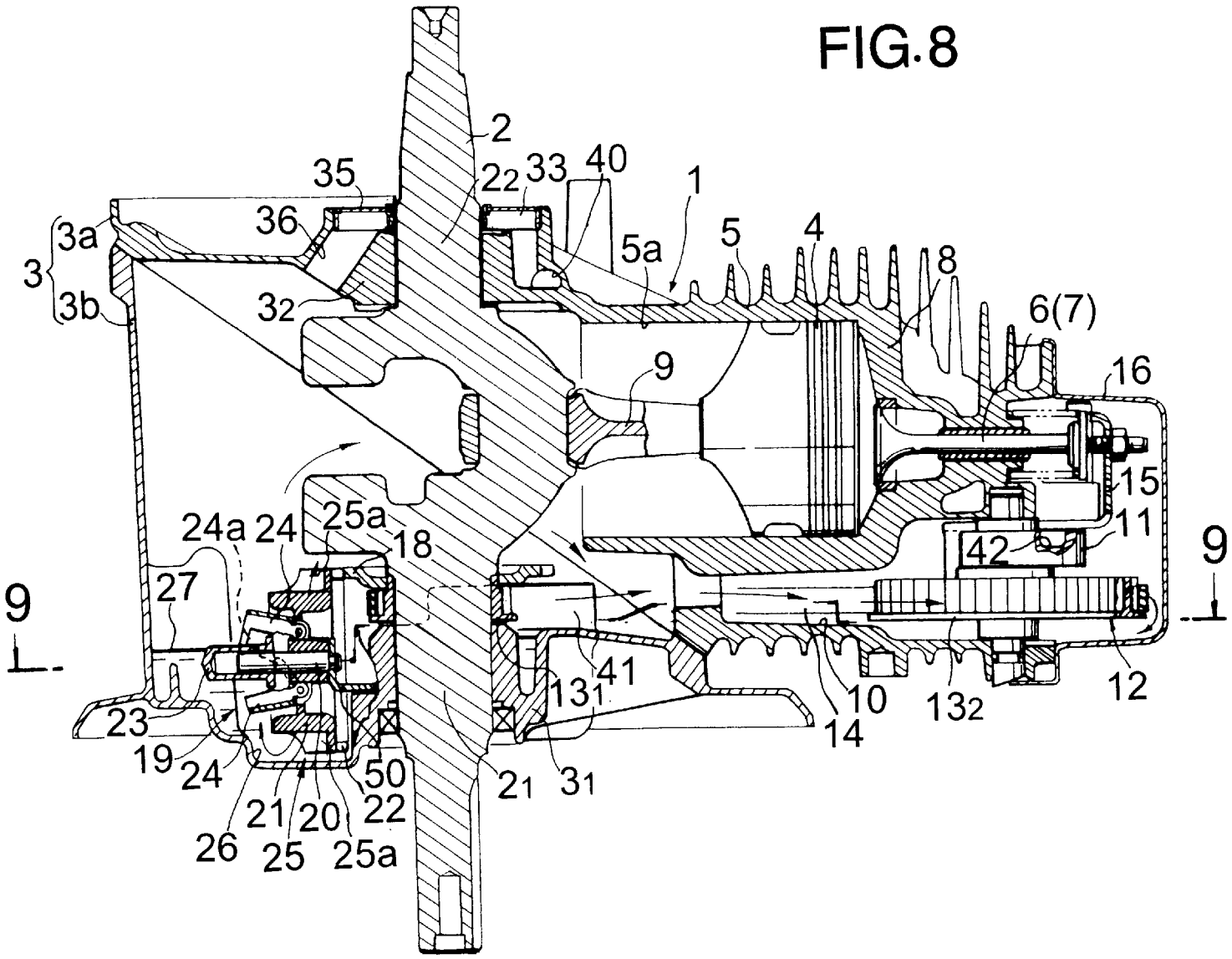
FIG. 8 is a vertical sectional view of an embodiment of the present invention applied to a vertical-type engine.
Figure 9:
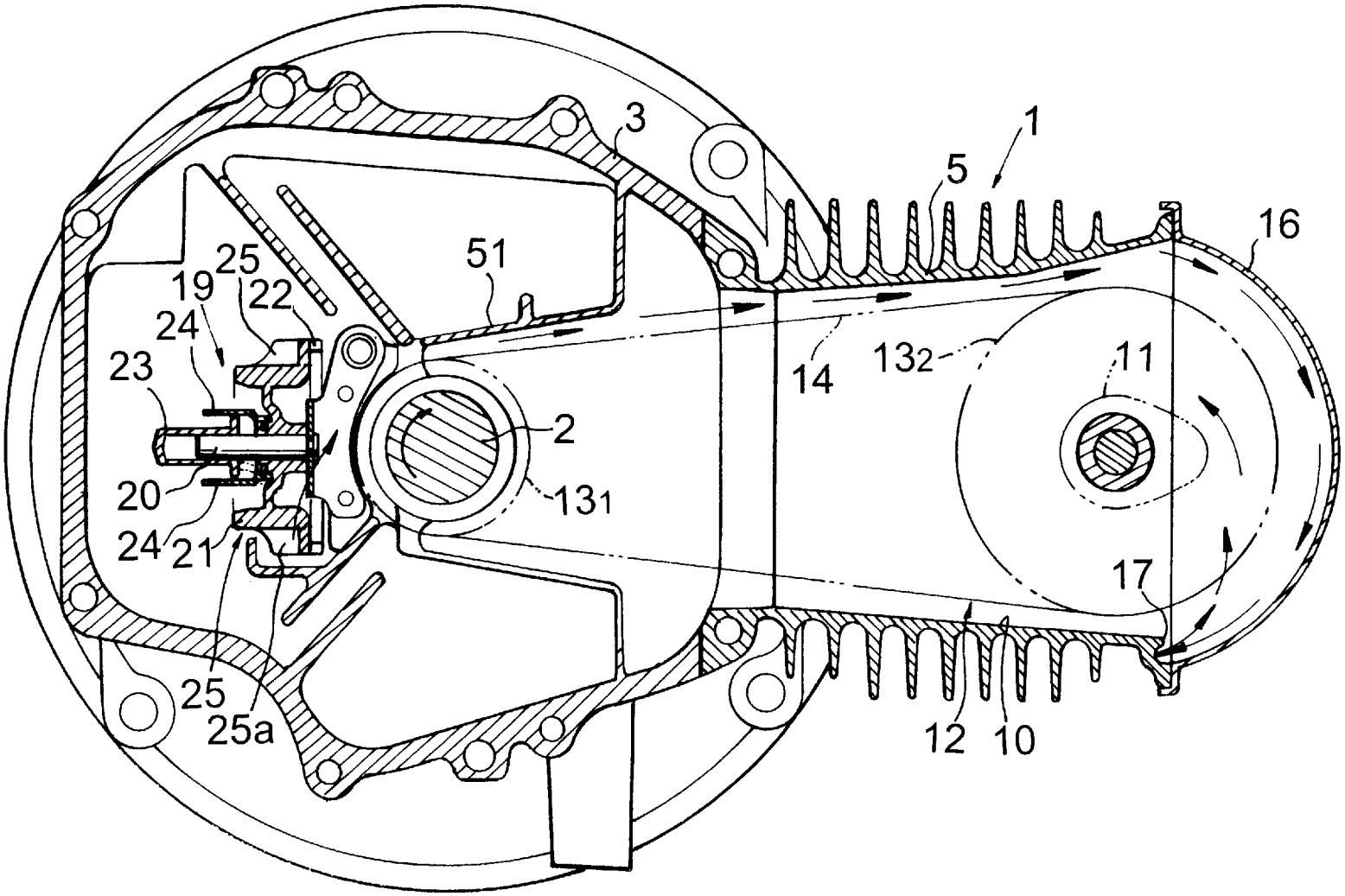
FIG. 9 is a sectional view taken along a line 9—9 in FIG. 8.
Figure 10:
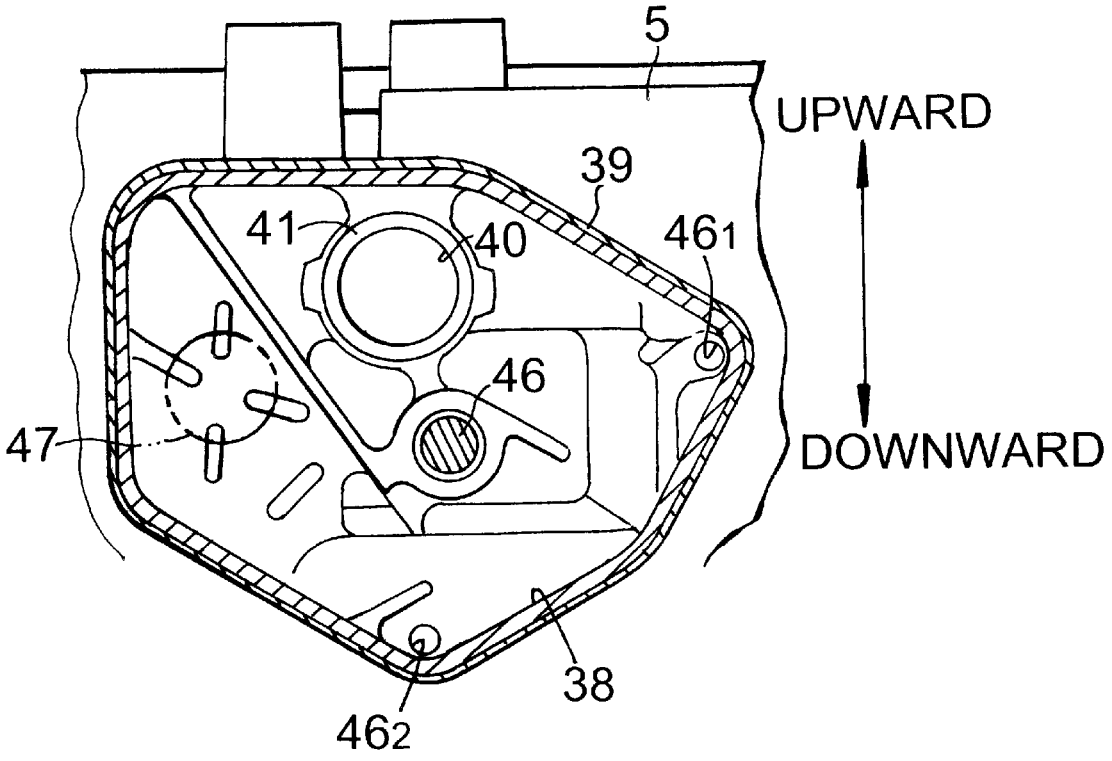
FIG. 10 is a sectional view similar to FIG. 6, but showing the attitude of a breather chamber according to the second embodiment of the present invention applied to the vertical-type engine.

The engine body 1 will now be described as being applied to a vertical-type engine with reference to FIGS. 8 to 10.

The engine body 1 is disposed so that the second bearing boss $3_2$ occupies a position above the first bearing boss $3_1$, in order to support the crankshaft 2 vertically. An oil reservoir chamber 26 lower than the chamber 10, is defined in the lower case half 36 of the crankcase 3, and the amount of lubricating oil 27 stored in the oil reservoir chamber 26 is set such that the timing transmitting device 12 is not immersed in the oil below the oil level.

The support shaft 20 of the speed-adjusting centrifugal governor 19 is horizontally secured to a bracket 50 secured to the inner wall of the lower case half 3*b*. A driven gear 22 is formed at an end face of rotary table 21 rotatably carried on the support shaft 20 and is meshed with a governor driving gear 18 secured to the crankshaft 2. The rotary table 21 has a plurality of vanes 25*a* projecting from an outer peripheral surface thereof to form an impeller 25, and a lower half of the rotary table 21 is immersed in the lubricating oil 27.

A guide wall 51 is integrally formed on an inner wall of the crankcase 3 to cover a path extending from the driving pulley $13_1$ to the valve-operating transmitting chamber 10 toward the driven pulley $13_2$. A recess 52, which functions as an oil reservoir, is provided in an upper end face of the valve-operating cam shaft 11.

Except that the oil dipper 28 is not provided on the connecting rod 9, the other sections are of the same construction as the horizontal-type engine and hence, in the figures, portions or components corresponding to those in the horizontal-type engine are designated by like reference characters.

During rotation of the crankshaft 2, the lubricating oil in the oil reservoir chamber 26 is allowed to splash by the rotation of the impeller 25. A portion of the splashed oil is guided by the guide wall 51 in the vicinity of the impeller 25, toward the chamber 10 and lubricates the timing transmitting device 12, the other valve-operating mechanism elements and the first journal portion $2_1$. The other portion of the splashed oil passes through the through-hole 36 in the second bearing boss $3_2$ into the annular chamber 33 as in the horizontal-type engine. In the vertical-type engine, however, the splashed oil is accumulated in the cone-shaped oil reservoir 37 in the upper surface of the second bearing boss $3_2$ and can effectively lubricate the second journal portion $2_2$ at a location above the first journal portion $2_1$.

As in the horizontal-type engine, the blow-by gas produced in the crankcase 3 is passed via the annular chamber 33 and the breather passage 40 into the breather chamber 38, where it is separated from the oil. The blow-by gas is guided through the breather tube 48 to the air cleaner (not shown) and discharged, and the separated oil is then returned to the crankcase 3 through the second return bore $46_2$ (see FIG. 10) which is at a lowermost portion of the breather chamber 38.

After stopping of the engine, the oil droplets are accumulated in the recess 52 in the upper end face of the valve-operating cam shaft 11 from above the recess 52. Upon restart of the engine, such oil is shaken off by the rotation of the valve-operating cam shaft 11 and is used in the lubrication of the valve-operating mechanism elements around the valve-operating cam shaft 11. Therefore, particularly even upon the start of the engine which has hitherto been in its stopped state, the valve-operating mechanism can be prevented from being out of the oil.

As discussed above, the annular chamber is provided in the second bearing boss and the splashed oil produced in the crankcase is passed into the chamber when the engine is either a horizontal-type or vertical-type. The breather chamber is provided in one side of the cylinder block and communicates with the annular chamber to separate gas and liquid, the breather chamber having a first return bore provided in a portion thereof which is a lowermost portion when in the horizontal-type engine to communicate with the inside of the crankcase, and a second return bore provided in a portion thereof which is a lowermost portion when in the vertical-type engine to communicate with the inside of the crankcase. The breather tube connected to the intake system of the engine is connected to the portion which is located above the first return bore when in the horizontal-type engine and above the second return bore when in the vertical-type engine. Therefore, while the same crankcase and cylinder block can be used in each of the types of engines, the second journal portion of the crankshaft can be always reliably lubricated by the splashed oil in each of the types, and it is possible to reliably perform the discharge of the blow-by gas from which the oil has been separated in the breather chamber, into the intake system through the same breather tube, and the circulation of the oil separated from the blow-by gas into the crankcase. The applicability of the crankcase and the cylinder block to both of the types of engines can enhance the mass productivity and largely contribute to a reduction in cost.

According to a second feature of the present invention, the cone-shaped oil reservoir extending down toward the second journal portion is defined in that end face of the second bearing boss which faces the annular chamber. Therefore, when in the vertical-type engine, the splashed oil entering the annular chamber can be accumulated in the oil reservoir to effectively lubricate the second journal portion, notwithstanding that the second journal portion is located above the first journal portion.

Although the embodiment of the present invention has been described in detail, it will be understood that the present invention is not limited to the above-described embodiment, and various modifications in design may be made without departing from the spirit and scope of the invention defined in claims.

We claim:

1. A lubricating and breather system in an engine having a crankcase and a cylinder block adapted for use in either a horizontal-type or vertical-type engine, and a crankshaft having first and second journal portions, the crankcase having first and second bearing bosses supporting the first and second journal portions of the crankshaft, wherein the first and second bearing bosses are positioned such that the second bearing boss lies above the first bearing boss when the engine is of the vertical-type, wherein the lubricating and breather system comprises an annular chamber in the second bearing boss for receiving splashed oil produced in the crankcase; a breather chamber which is in one side of the cylinder block communicating with the annular chamber to separate gas and liquid, the breather chamber having a first return bore located at a portion thereof which is a lowermost portion when the engine is a horizontal-type, for communicating with the inside of the crankcase, and a second return bore located at a portion thereof which is a lowermost portion when the engine is a vertical-type, for communicating with the inside of the crankcase; and a breather tube adapted to be operatively coupled to an intake system of the engine and connected to a portion of the breather chamber, said breather chamber being located above the first return bore when the engine is a horizontal-type and above the second return bore when the engine is a vertical-type.

2. A lubricating and breather system in an engine according to claim 1, including a cone-shaped oil reservoir in an end face of the second bearing boss facing the annular chamber, the cone-shaped oil reservoir extending down toward the second journal portion.

* * * * *